United States Patent [19]

Brown

[11] Patent Number: 4,711,377

[45] Date of Patent: Dec. 8, 1987

[54] COUPLER AND PUMP FOR A BEVERAGE DISPENSER

[75] Inventor: Anthony D. Brown, Woodland Hills, Calif.

[73] Assignee: Grundy Dispense Systems, Inc., Canoga Park, Calif.

[21] Appl. No.: 832,309

[22] Filed: Feb. 24, 1986

[51] Int. Cl.[4] ..... B67D 1/04

[52] U.S. Cl. ..... 222/400.7; 222/401; 137/212; 137/322

[58] Field of Search ..... 222/400.7, 400.8, 401; 137/212, 322

[56] References Cited

U.S. PATENT DOCUMENTS

| | | | |
|---|---|---|---|
| 1,752,090 | 3/1930 | Johannsen | 222/400.8 UX |
| 2,028,553 | 1/1936 | Lubin | 222/400.8 |
| 2,049,851 | 8/1936 | Madan | 222/400.8 X |
| 3,220,617 | 11/1965 | Veistrup | 222/400.7 |
| 4,181,143 | 1/1980 | Fallon | 137/322 |
| 4,350,270 | 9/1982 | Nezworski | 222/400.7 X |
| 4,520,954 | 6/1985 | Brown | 222/400.7 |

*Primary Examiner*—Joseph J. Rolla
*Assistant Examiner*—Frederick R. Handren
*Attorney, Agent, or Firm*—Thomas I. Rozsa

[57] ABSTRACT

A coupler and air pump for pressurizing a sealed beverage container having a valve, such as a beer keg, and for dispensing a beverage from such a container. The Handpowered air pump housing is joined to a metallic coupler by a threaded collar. Cams on the lower end of the coupler lock into the container valve and a handle actuates a probe in the coupler to open the valve of the container.

13 Claims, 3 Drawing Figures

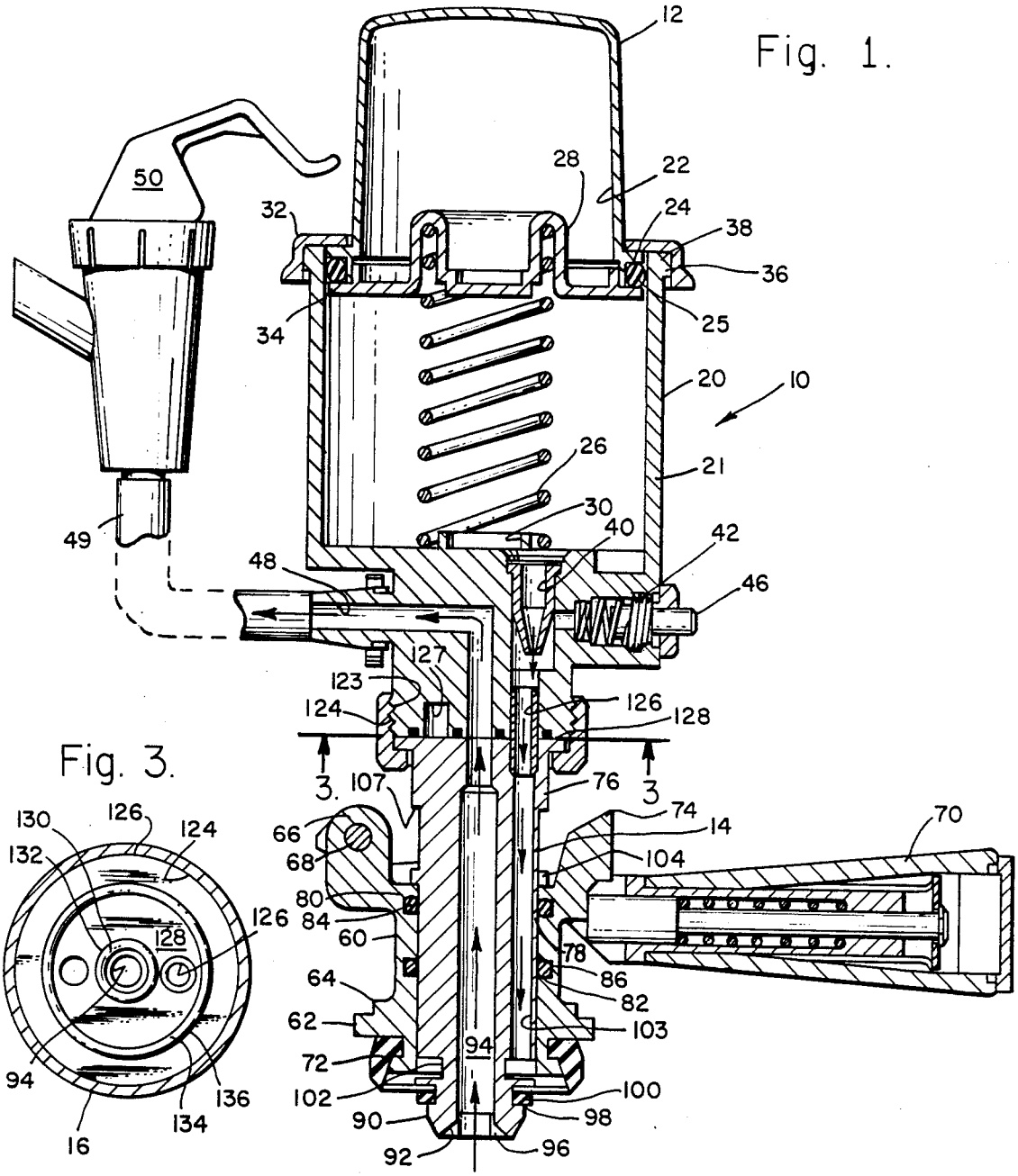
Fig. 1.
Fig. 3.
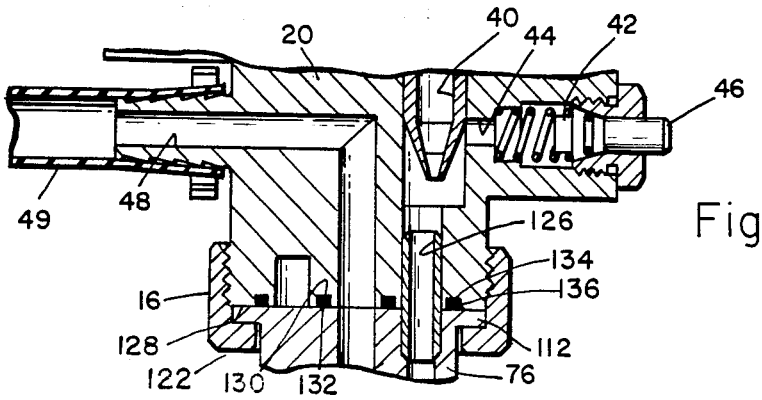
Fig. 2.

COUPLER AND PUMP FOR A BEVERAGE DISPENSER

BACKGROUND OF THE INVENTION

1. Field of the Invention

The present invention relates to an improved device for coupling with and tapping a keg of beer and for pressurizing it using a pump.

2. The Prior Art

To tap a keg of beer or similarly packaged beverage, a coupler is screwed into a valve assembly in the container through use of thread-like mating cams and lugs. A probe at the insertion end of the coupler depresses the valve mechanism, typically a spring loaded ball valve, permitting the flow of pressurizing gas and the flow of beer or other liquid. A suitable tap, that is, a dispenser, is attached to the distal end of the coupler.

Two general types of couplers are currently in widespread use. One is a commercial coupler, which uses pressurized carbon dioxide gas, typically bottled, to pressurize the keg. The other is a consumer coupler, which uses an air pump, that is a hand-powered compressor to pressurize the container. The consumer coupler is more readily portable and is therefore commonly known as a picnic coupler and pump system.

A typical commercial coupler is described in U.S. Pat. No. 4,181,143, issued to Fallon. The coupler includes thread-like cams at its lower face, which are accommodated by mating lugs on the inner circumference of the of the container opening adjacent the valve assembly. Then, by a separate action, a handle or cam actuates a movable probe inside the coupler, which pushes against the ball valve assembly and thereby permits the flow of fluid into and out of the container through appropriate channels. The probe, which forces the ball valve away from its seat, moves relative to its surrounding cam, which secures the coupler to the container. This type of coupler and dispenser requires use of an external and bulky source of gas to pressurize the container. The commercial coupler, however, also enjoys significant advantages, which include: widespread consumer acceptance, in both commercial and consumer practice; and a sturdy mechanism that does not usually leak and is long lived, even in the face of hard use.

In a conventional picnic pump system, the coupler is inserted by rotation into the valve assembly in the same manner as the commercial coupler. This compatibility is virtually required because nearly all beer kegs use the same standard coupling system. After the consumer coupler is secured to the container, a second rotating action rotates a movable probe, causing it to move into the container and to push the ball valve off its seat, permitting fluid to flow into and out of the container through appropriate channels. This type of consumer coupler may leak around the probe and locking cams. Consumer couplers having a fixed probe are also known in the prior art, as illustrated by U.S. Pat. No. 4,520,954, issued to Brown. In this type of consumer probe, the probe head protrudes from the coupling cams of the coupler, so that the probe head engages and opens the ball valve in the container before the coupling cams of the coupler are fully engaged with the coupling lugs of the container. Naturally, this leads to leaking of the fluid from the container, which typically is under pressure prior to opening of the valve. A flexible bellows-type seal around the circumference of the coupler reduces the leakage associated with tapping a pressurized container with this type of coupler. Such couplers are, however, not widely accepted by the consumer since they may appear to be less sturdy than commercial couplers and they tend to leak occasionally.

Therefore, a significant need exists for a coupler and dispensing system that combines the advantages of the commercial coupler and the consumer coupler, resulting in a coupler and pump that is familiar and therefore easy to use, does not leak, is readily portable, and is long-lasting.

SUMMARY OF THE PRESENT INVENTION

Accordingly, it is an object of the present invention to provide a consumer coupler and pump that is familiar to consumers and is easy to use.

Another object of the present invention is to provide a consumer coupler and pump that is durable and long lived.

Another object of the present invention is to provide a consumer coupler and pump that is easy to maintain and clean.

Another object of the present invention is to provide a consumer coupler and pump that is readily portable.

These and other objects of the present invention are achieved by providing a consumer coupler and pump comprising a commercial-like coupler detachably joined to a consumer pump, thereby providing the advantages of both, through means of a rotatable collar as illustrated in the figures, and as described and claimed in this patent.

BRIEF DESCRIPTION OF THE DRAWINGS

FIG. 1 is a sectional side elevation of a coupler and pump according to the present invention;

FIG. 2 is a detail side elevation of the means for joining the coupler and pump of the present invention.

FIG. 3 is a fragmentary sectional view taken along line 3—3 of FIG. 1.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring to FIG. 1 and FIG. 2, a coupler and pump 10 according to the present invention includes air pump 12 and coupler 14, removably joined together by threaded collar 16 for facilitating manufacture, repair and cleaning.

Air pump 12 includes pump housing 20, including cylinder 21, which removably receives piston and cylinder cap 22, which compresses air within air pump 12 for delivery to a beverage container when pushed toward the bottom of cylinder 21. Piston 22 includes circumferential groove 24 receiving and retaining sealing element 25, which may be an O-ring, about its lower circumference for sliding and sealing engagement with the inner wall of cylinder 21 during a downward stroke. Coil spring 26, vertically disposed within cylinder body 20, is compressed when piston 22 is depressed, thereby providing a force for returning piston 22 to the top of its stroke (as illustrated in FIG. 1) after a downward compression stroke. Coil spring 26 is retained in its vertical orientation by being received in circular recess 28 of the bottom of piston 22, and, at its distal end, by a roughly semicircular ridge 30 on the bottom interior portion of cylinder 21.

Piston 22 is removably retained within cylinder body 20 by annular collar 32. The circumferential groove 24 portion of piston 22 is located in flange 34 projecting perpendicularly from piston 22, thereby forming a wider bottom portion of piston 22.

The bottom of the flange portion 34 contains a multiplicity of slots (not shown) thus allowing free flow of air around the seal and into the cylinder during the spring assisted upstroke.

To assemble air pump 12, annular collar 32 is slipped over the top of piston 22. It cannot pass over flange 34 of piston 22, however. Annular collar 32 is then seated on the top of cylinder body 20, where it is retained by recesses 36 that mate with ridges 38 at the top of cylinder body 20. This simple assembly procedure permits the air pump to be quickly and readily disassembled for the necessary frequent cleaning and for maintenance.

Air passage 40 extends from the interior bottom wall of cylinder 20 through the end of pump housing 20 for conducting compressed air generated by actuation of piston 22 through coupler 14 and ultimately into a container. Intersecting air passage 40 is air vent passage 44, which fixedly receives vent valve 42, for releasing excess pressure in the container during use or for depressurizing the container before removal of the coupler and pump from the container. Air vent valve 42, a conventional component often made of nickel plated brass, is actuated by depressing button 46, allowing gas to escape around the circumference of button 46. Air pump 12 also includes beverage passage 48 for transferring the pressurized beverage from the container to a hose and faucet 50 for dispensing the beverage.

Air pump 12 may be made of any suitable materials. Typically, pump housing 20, including air passage 40, vent passage 44, beverage passage 48, and piston 22 are made of plastic and are formed through a suitable molding process well known to those skilled in the art. Sealing element 25 is made of rubber, neoprene, or other suitable material. Coil spring 26 is advantageously made of spring steel. Hose 49 is customarily made of flexible plastic tubing and faucet 50 is conveniently made of plastic and includes a suitable flexible seal in the valve.

Coupler 14 comprises a basically cylindrical housing 60 having thread-like cams 62 formed downwardly from flange 64 at the base of housing 60 for sealing engagement with mating lugs on the valve body of a container (not shown), hinge flange 66 for receiving hinge pin 68, which secures control handle 70. The lowermost portion of housing 60 retains cylindrical gasket 72 about its outer circumference, for sealing engagement with a valve body in a container. Opposite hinge flange 64 is locking lug 74 for allowing handle 70, and thereby probe 76, which handle 70 controls, to be locked into the container tapping position (that is, in the downward position), which is illustrated in FIG. 1).

The interior of housing 60 consists of cylindrical bore 78 for receiving probe 76. Cylindrical bore 78 includes two spaced recessed circumferential grooves 80, 82 for retaining sealing gaskets such as O-rings 84, 86, which prevent leakage between probe 76 and cylindrical bore 78.

Chrome plated brass is a preferred material for making housing 60. Housing 60 may be conveniently made by forging casting and all close-tolerance surfaces, that is, cylindrical bore 78, bottom or mating surface of thread-like cams 62, and the lowermost surface of housing 60, are all machined to provide smooth and well-fitting working surfaces.

Probe 76 fits slidably within cylindrical bore 78. Probe 60 includes probe head 90 for engaging and opening the ball valve of a container and includes hemispherically-concave recess 92 formed in tapered split end 96 of probe head 90. Hemispherically-concave recess 92, in operation, receives a portion of the spherical ball of the ball valve of the container, pushing it open. In the center of tapered split end 96 of probe head 90 is cylindrical bore 94 for receiving and transporting beverage from the container, through coupler 14, beverage passage 48 of air pump 12, hose 49 and faucet 50 for dispensing. Immediately adjacent tapered split end 96 is circular recess 98 for retaining gasket 100, customarily an O-ring. Gasket 100 seals the joint between tapered split end 96 and the beverage conveying portion of the ball valve assembly in the container. Spaced from circular recess 98 is recess 102, marking the end of the actual engagement portion of probe head 90, and providing an entrance opening for a second bore through the body of probe 76 that does not communicate with cylindrical bore 94, which conveys the beverage. Accordingly, a cylindrical bore, forming air passage 103 through coupler 14, is parallel to cylindrical bore 94, but does not communicate with it, and is off-set from the center of probe 76. Air passage 103 extends above flange 104 as illustrated. In operation, when actuated, probe 76 penetrates the lower end of coupler housing 60, permitting pressurizing air to pass through air passage 103 and into the valve of a container. In operation, air passage 103 of probe 76 is sealed with the container by gasket 72 about the lower end of coupler housing 60.

Flange 104, formed by machining down adjacent portions of probe 76, will not pass through bore 78 in housing 60, thereby limiting the downward length of the stroke that can be applied to probe 76 and preventing damage to the ball valve assembly of a container. Adjacent to flange 104 is landing 107, of slightly greater diameter than flange 104, for engaging with lugs of handle 70 when handle 70 is moved to raise or lower probe 76. Adjacent to landing 107 is flange 112, forming the top end of probe 76, that is, the end distal from probe head 90. Flange 112 has the largest diameter of any portion of probe 76. Flange 112 retains collar 16, which joins air pump 12 and coupler 14.

Brass is a preferred material for making probe 76, which may be chrome plated to prevent corrosion. The upper surface, that is, the surface that mates with air pump 12, and hemispherical recess 92 are closely machined to provide smooth close-fitting working surfaces.

Collar 16 includes inwardly projecting flange 122 and interior threads 124. To assemble the unit, collar 16 is slipped over probe head 90 until collar 16 is seated against flange 112 of probe 76. Then the base of air pump 12, which is equipped with matching threads 123, and collar 16 are screwed together to form a coupler and pump assembly that can be readily dismantled for cleaning or repair. The base of air pump 12 also contains molding passage 127.

Rolled pin 126, having a hollow interior, is pressed into air passage 103 at the top 128 of probe 76, with a portion of it projecting from top 128. During assembly, rolled pin 126 aligns air passage 103 of probe 76 with air passage 40 of air pump 12, into which it penetrates, to prevent rotation of air pump 12 relative to probe 76 during assembly, use, or disassembly.

Top 128 is machined smooth. Beverage passage 48 of air pump 12 and cylindrical bore 78 (beverage passage) of coupler 14 are sealed by gasket 130, retained by circular recess 132 in the bottom surface of air pump 12. The joinder of the two air passages is sealed by larger gasket 134, which is retained in circular recess 136 about the circumference of the bottom of air pump 12. Gaskets 130, 134 may advantageously be O-rings. Force provided by the threads of collar 120 and air pump 12 keep the seals tight during use. FIG. 3 clearly illustrates the relationships of these seals and passages in the bottom of air pump 12, in what is basically a plan view of the lowest surface of pump housing 20.

While the preferred embodiment of the invention has been described in detail, it is apparent that various changes and modifications within the scope of this invention may occur to those skilled in the art. Accordingly, the detailed description is not intended to limit the features of the invention or the scope of the patent property to be granted, which should be measured solely by the claims that follow.

What is claimed is:

1. A coupler and pump for dispensing a beverage from a container having a valve, comprising:

a. an air pump;

b. a coupler;

c. said air pump further comprising a pump housing including an interior cylinder having a floor and the pump housing including a base;

d. a piston retained within said cylinder of said pump housing for providing a source of compressed air;

e. means for returning said piston to the top of its stroke, the returning means being retained within said pump housing;

f. an air passage extending from the floor of said cylinder through the base of said pump housing;

g. a beverage passage within said base of said pump housing;

h. said coupler further comprising a coupler housing including a central cylindrical bore therein;

i. a substantially cylindrical probe movably seated within said cylindrical bore of said coupler housing, wherein said probe further includes a probe head for sealing engagement with the valve of a container of beverage, a top-end remote from said probe head, a first flange adjacent the top end of the probe, a second flange delineating the end of said probe head, a recess adjacent said second flange, a central longitudinal beverage passage, an air passage parallel to but offset from said beverage passage, said air passage running from the top end of the probe to said recess adjacent to said second flange, and means for sealing said air passage and said beverage passage of said probe head relative to the container valve and from each other;

j. means for actuating said movable probe;

k. means for rotatably joining said coupler to a container valve;

l. means for aligning said air and beverage passages in said probe with said air and beverage passages in said base, respectively and preventing rotation of said probe relative to said air pump; and m. means for joining the base of said air pump to the top end of said probe.

2. A coupler and pump in accordance with claim 1 wherein said coupler further comprises means for sealing engagement of said probe within said cylindrical bore of said coupler housing.

3. A coupler and pump in accordance with claim 1 wherein said actuating means further comprises a handle hingably attached to said coupler housing and engaging said probe.

4. A coupler and pump in accordance with claim 1 wherein said rotatably joining means further comprises thread-like cams.

5. A coupler and pump in accordance with claim 1 wherein said means for aligning said probe with said air pump and preventing rotation of said probe relative to said air pump further comprises a hollow longitudinal member seated within said air passage of said probe at the top end thereof with a portion of said hollow longitudinal member extending outwardly from the top end.

6. A coupler and pump in accordance with claim 5 wherein said hollow longitudinal member further comprises a rolled pin.

7. A coupler and pump in accordance with claim 1 wherein said means for joining said air pump to said coupler comprises threads formed about the base of said pump housing and an internally threaded collar, said collar including an inwardly projecting annular flange which is seated under said first flange at the top end of said probe.

8. A coupler and pump in accordance with claim 1 wherein said air pump further comprises an air vent passage formed in the base of the pump housing and intersecting said air passage and a vent valve seated in the air vent passage.

9. A coupler and pump for dispensing a beverage from a container having a valve, comprising:

a. an air pump including a housing having a base, an air passage in said base, and a beverage passage in said base;

b. a coupler including a coupler housing including a central cylindrical bore, a substantially cylindrical probe movably seated within said coupler housing, said probe including a probe head and a top end remote from said probe head, a centrally located longitudinal beverage passage and a parallel but offset air passage; and c. means for joining said base of said air pump to said top end of said probe to thereby establish communication between said air and beverage passages in said base and said air and beverage passages in said probe, respectively.

10. A coupler and pump in accordance with claim 9 further comprising means for aligning said base of said air pump with said top end of said probe.

11. A coupler and pump in accordance with claim 10 wherein said aligning means further comprises a hollow longitudinal member seated within said air passage of said coupler at the top end of said probe with a portion of said hollow longitudinal member extending outwardly from said top end.

12. A coupler and pump in accordance with claim 1 wherein said hollow longitudinal member further comprises a rolled pin.

13. A coupler and pump in accordance with claim 9 wherein said means for joining said air pump and said coupler further comprises:

a. a collar having internal threads and an inwardly projecting annular flange;

b. threads about the exterior of said base of the air pump housing for receiving said collar; and c. a flange adjacent the top end of said probe for seating against said flange of said collar whereby said coupler and said air pump are detachably fastened together by said collar.

* * * * *